US006019251A

United States Patent [19]

Koga

[11] Patent Number: 6,019,251

[45] Date of Patent: Feb. 1, 2000

[54] EXTRUSION EQUIPMENT FOR TWO-PART REACTIVE CURING MATERIALS AND COATING EQUIPMENT USING THE SAME

[75] Inventor: Hiroyuki Koga, Tokyo, Japan

[73] Assignee: Denki Kagaku Kogyo Kabushiki Kaisha, Tokyo, Japan

[21] Appl. No.: 09/101,190

[22] PCT Filed: Nov. 28, 1997

[86] PCT No.: PCT/JP97/04354

§ 371 Date: Jul. 10, 1998

§ 102(e) Date: Jul. 10, 1998

[87] PCT Pub. No.: WO98/23387

PCT Pub. Date: Jun. 4, 1998

[30] Foreign Application Priority Data

Nov. 29, 1996 [JP] Japan ..... 8-318933
Mar. 27, 1997 [JP] Japan ..... 9-74720

[51] Int. Cl.[7] ..... B65D 35/22

[52] U.S. Cl. ..... 222/94; 222/103; 222/136; 222/145.5; 222/326; 222/391

[58] Field of Search ..... 222/94, 103, 136, 222/132, 145.5, 145.6, 325, 326, 391

[56] References Cited

U.S. PATENT DOCUMENTS

| | | | |
|---|---|---|---|
| 3,608,782 | 9/1971 | Sathicq | 222/94 |
| 4,840,294 | 6/1989 | Ernst | 222/391 |
| 5,192,008 | 3/1993 | Hwan | 222/391 |
| 5,195,660 | 3/1993 | Lekes | 222/103 |
| 5,217,144 | 6/1993 | Santefort et al. | 222/103 |
| 5,501,374 | 3/1996 | Laufer et al. | 222/391 |

FOREIGN PATENT DOCUMENTS

| | | | |
|---|---|---|---|
| 0 601 244 B1 | 6/1994 | European Pat. Off. . | |
| 4-19909 | 3/1992 | Japan . | |
| 5-305957 | 11/1993 | Japan . | |
| 7-163925 | 6/1995 | Japan . | |
| 8302712 | 8/1983 | WIPO | 222/94 |

*Primary Examiner*—Joseph A. Kaufman
*Attorney, Agent, or Firm*—Armstrong, Westerman, Hattori, McLeland & Naughton

[57] ABSTRACT

The invention relates to extrusion equipment C in that a pushing plate 12 is disposed on a base plate 1 to incline vertically with both tubes 2 containing two-part reactive curing materials interposed between them, the pushing plate 12 is inclined downward to squeeze both tubes 2 to simultaneously extrude both materials when a grip 8 disposed on the bottom face of the base plate 1 is held to pull a lever 9 positioned in front of the grip 8, and a coating device A provided with a nozzle B which is connected to both tubes 2 set on the extrusion equipment C to jointly discharge both materials which are extruded from both tubes 2.

6 Claims, 11 Drawing Sheets

Fig.11 – (a)
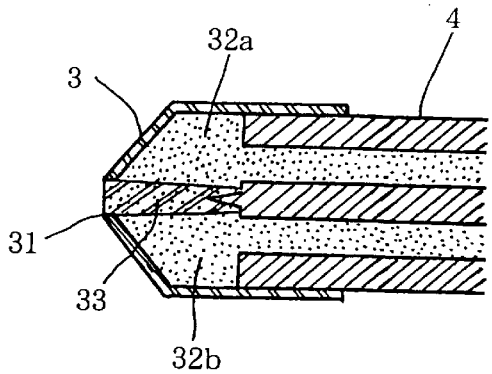
Fig.11 – (b)
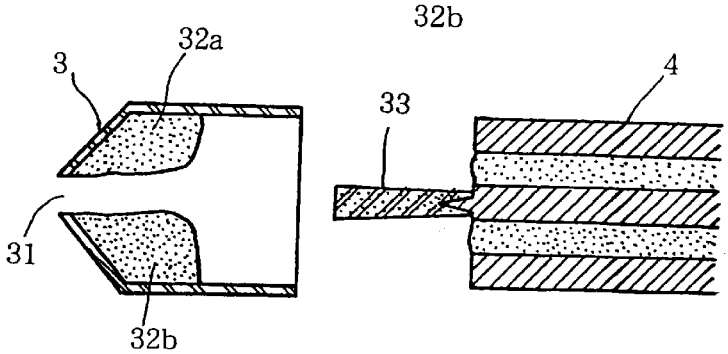
Fig.12 – (a)
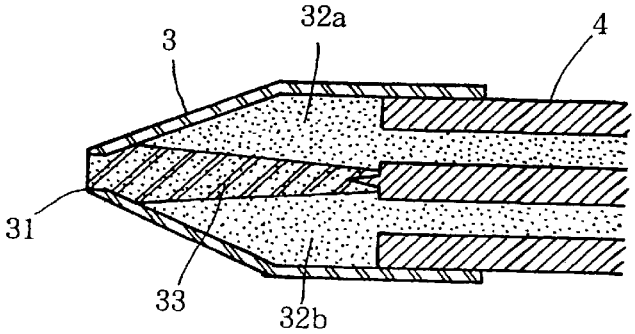
Fig.12 – (b)
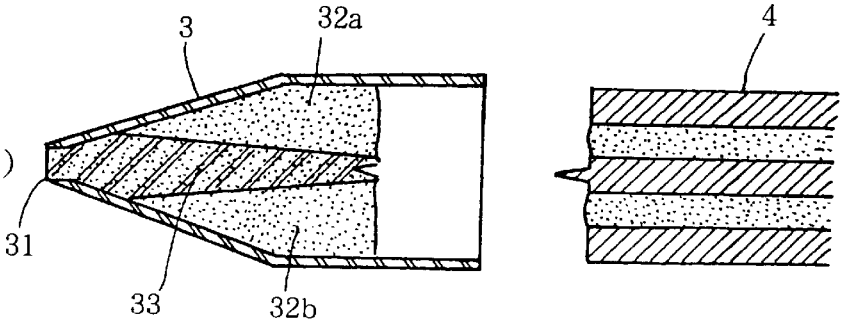

EXTRUSION EQUIPMENT FOR TWO-PART REACTIVE CURING MATERIALS AND COATING EQUIPMENT USING THE SAME

TECHNICAL FIELD

The invention relates to extrusion equipment which can extrude simultaneously two-part liquid reactive curing materials separately stored in two tubes and represented by a two-part adhesive, and to coating equipment having a nozzle to discharge together the two-part liquid reactive curing materials extruded by the extrusion equipment.

BACKGROUND ART

Conventionally known extrusion equipment for a two-part adhesive representing two-part reactive curing materials and coating equipment provided with the same include extrusion equipment, which holds two tubes of a two-part adhesive held among three mutually opposing parallel pushing plates, has a screw rod having reverse threads from its center pierce through the three pushing plates and threaded into tapped holes of the two outer pushing plates and rotates the screw rod to narrow a space between the two outer pushing plates to extrude the adhesives from the tubes simultaneously, and coating equipment, which is provided with the above extrusion equipment and a nozzle connected to the respective tubes so that the extruded adhesives can be discharged jointly (Japanese Utility Model Application Laid-Open Publication No. Hei 2-138183).

Another known extrusion equipment is provided with two cylindrical cartridges to keep two-part adhesives separately, a grip, a lever and two extrusion rods having a piston-type pushing part at each leading end, and another coating equipment is provided with the above extrusion equipment and a nozzle connected to the leading ends of the cartridges, wherein the two cartridges are mounted on the extrusion equipment with the two push rods pulled out backwards, the grip is held to pull the lever to extrude the adhesives from the respective cartridges by the pushing parts to the nozzle to discharge jointly (Japanese Utility Model Application Laid-Open Publication No. Hei 5-80563).

However, in the extrusion equipment for extruding the adhesives from the tubes and the coating equipment provided with the same extrusion equipment described above, the equipment is held with one hand and the screw rod is rotated with the other hand to discharge the adhesive, namely two hands are required for working. And the extrusion equipment is not stable while the screw rod is rotated, so that the adhesive is not discharged stably to a predetermined position and workability is poor.

And, the extrusion equipment for extruding the adhesives from the cartridges and the coating equipment provided with the same extrusion equipment require that the two-part adhesives stored in the exclusive cartridges are separately produced or tube two-part adhesives generally available on the market must be refilled into the exclusive cartridges. Where the two-part adhesives stored in the dedicated cartridges are produced separately, there are disadvantages that the cartridges which serve as the cylinder must be disposable, resulting in increasing their cost higher than the tubes and the refilling work is troublesome.

SUMMARY OF THE INVENTION

The invention has been achieved in view of the above disadvantages and aims to provide extrusion equipment, which can extrude inexpensive and widespread tube two-part reactive curing materials from their tubes with one hand, and to improve coating workability with coating equipment provided with the same extrusion equipment.

The above objects can be achieved by extrusion equipment for two-part reactive curing materials, which comprises a base plate which has a grip and a lever in front of the grip on its bottom face and two tubes of two-part reactive curing materials with their respective mouths directed forward on its top face; a pushing plate which has its rear end pivotably fixed to the rear end of the base plate to allow a vertical inclination on the base plate and to sandwich the bodies of the tubes with the base plate; and a pushing plate-inclining means which transmits a pulling force of the lever to the pushing plate as a force to incline the pushing plate downward, and a coating device for two-part reactive curing materials, in the extrusion equipment for two-part reactive curing materials, which has a nozzle which is disposed connected to the mouths of both tubes on the base plate for jointly discharging the materials extruded from both tubes.

With the extrusion equipment according to the invention, the grip is held with one hand to pull the lever, so that the two tubes of the two-part reactive curing materials can be held and pushed between the base plate and the pushing plate to extrude the materials from the tubes simultaneously. With the coating equipment according to the invention, both materials can be joined by operating with one hand only and discharged from the nozzle, so that the coating work becomes simple and easy.

The invention will be described in further detail with reference to the accompanying drawings.

BRIEF DESCRIPTION OF THE DRAWINGS

FIGS. 11(*a*) and (*b*) are explanatory diagrams of a first type of the nozzle shown in FIG. 10;

FIGS. 12(*a*) and (*b*) are explanatory diagrams of a second type of the nozzle shown in FIG. 10;

DETAILED DESCRIPTION OF THE PREFERRED EMBODIMENTS

Figure 1:
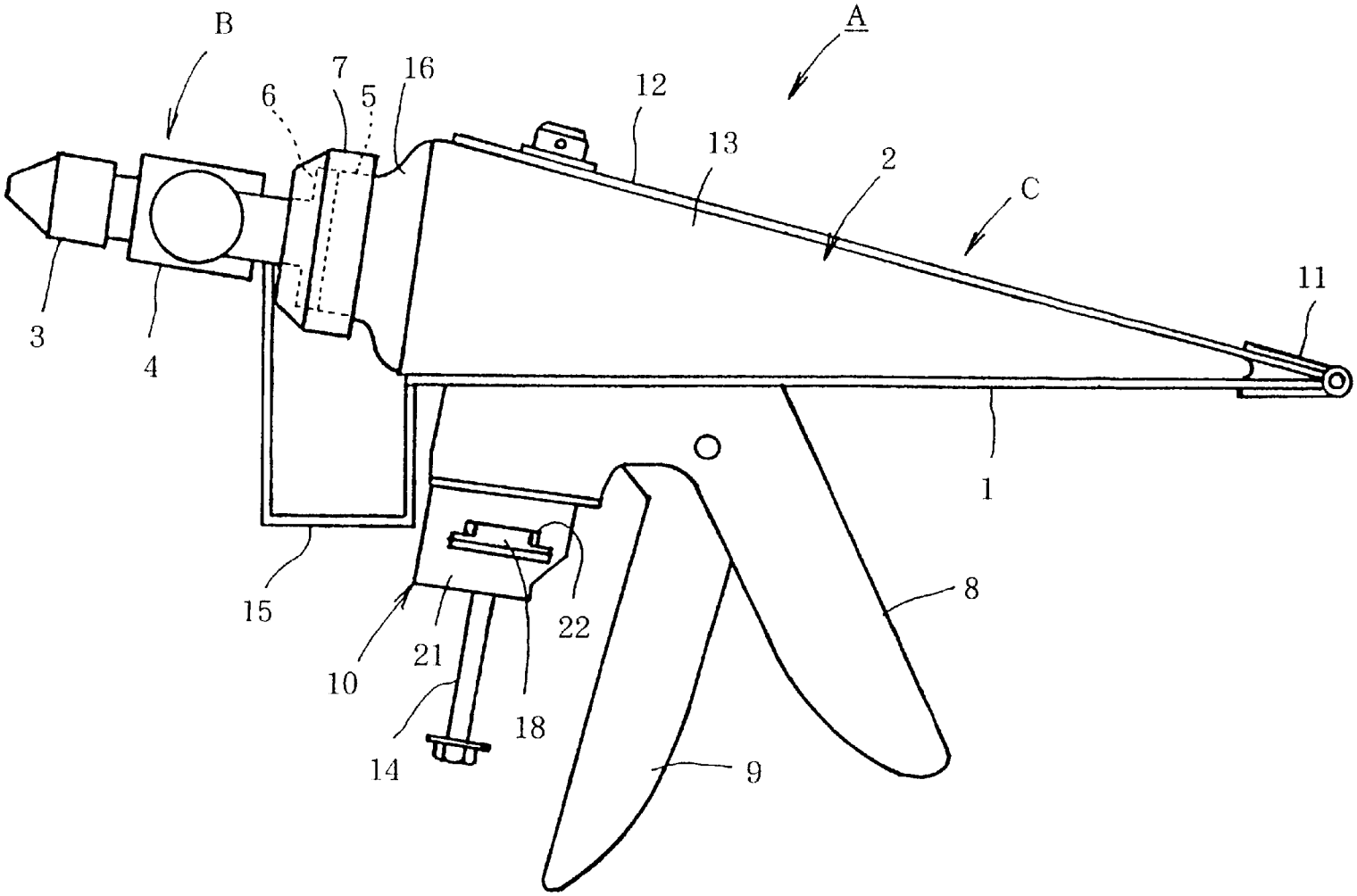
FIG. 1 is a side view of coating equipment for two-part reactive curing materials according to a first embodiment of the invention.
Figure 2:
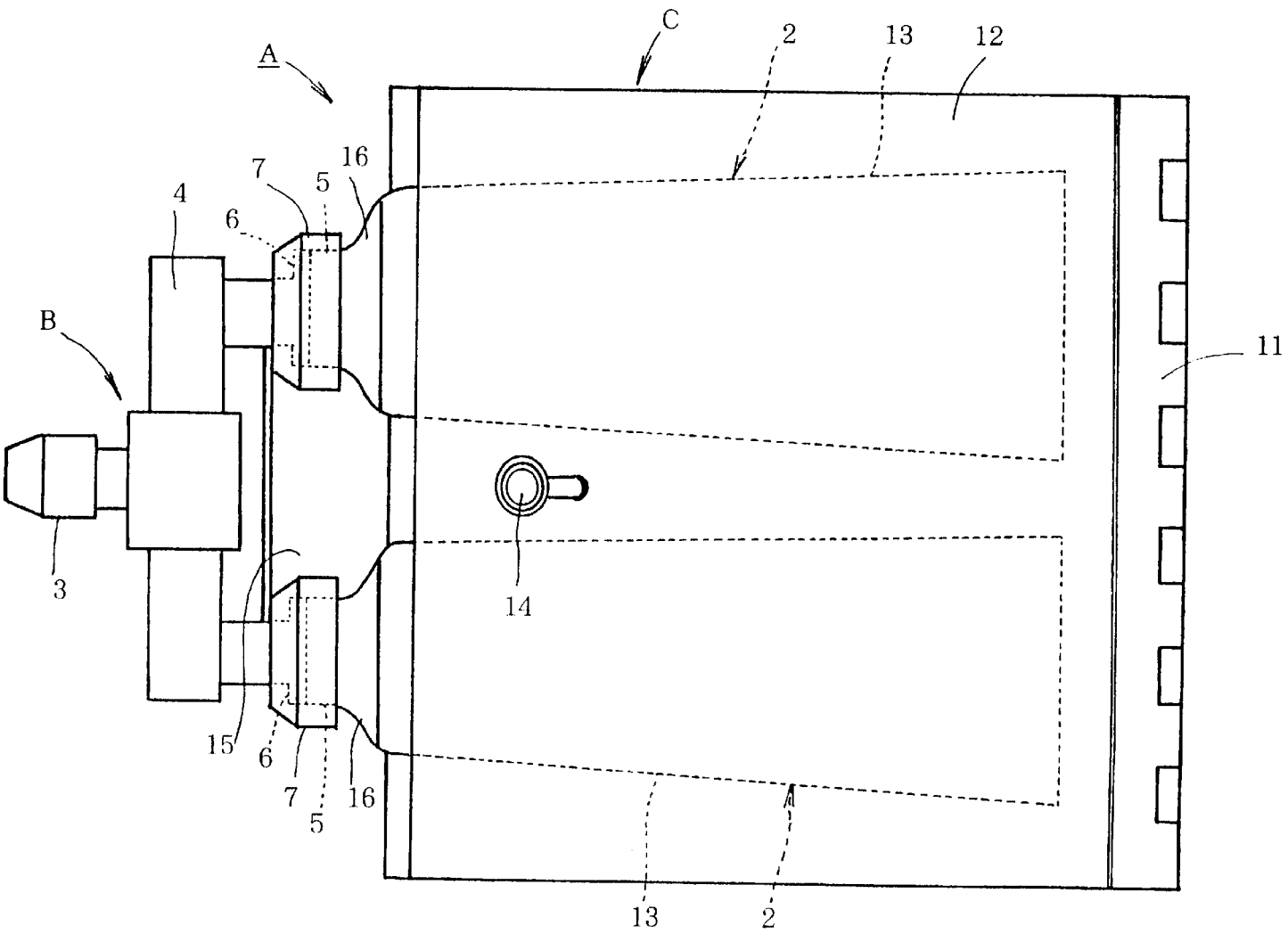
FIG. 2 is its plan view.

FIG. 1 is a side view showing coating equipment A according to a first embodiment of the invention, and FIG. 2 is a plan view thereof.

It is seen from the drawings that the coating equipment A of this embodiment comprises a nozzle section B and extrusion equipment C.

The nozzle section B will be described first.

The nozzle section B is removably connected to two tubes 2 placed on a base plate 1 of the extrusion equipment C to discharge jointly two-part reactive curing materials extruded from the tubes 2 and comprises a nozzle body 3 and a guide pipe 4. The nozzle body 3 is removably connected to the leading end of the guide pipe 4. The guide pipe 4 has its rear end branched toward mouth parts 5 of the two tubes 2 and respective branches connected to the tubes 2. The guide pipe 4 serves to guide the materials extruded from the tubes 2 to the nozzle 3 without joining the materials, which are jointly discharged from the nozzle body 3.

The guide pipe 4 is used to guide the materials extruded from the two tubes 2 to the nozzle body 3 without joining the materials so that the materials are not cured in the guide pipe 4 even if use of the coating equipment is paused or stopped. If the guide pipe 4 and the nozzle body 3 are made disposable or cleaned after every use, the materials may be joined in the guide pipe 4. But, since this embodiment does not join the materials in the guide pipe 4 and removably attaches the nozzle body 3 to the guide pipe 4, it is preferable that the guide pipe 4 is reusable and only the nozzle body 3 needs cleaning after use.

The guide pipe 4 and the nozzle body 3 are made of a material which is not degraded by the two-part reactive curing materials. Materials for the guide pipe 4 includes, for example, aluminum, stainless steel, polyacetal, polypropylene, polyester and the like. And, materials for the nozzle body 3 include low-density polyethylene, high-density polyethylene, polypropylene, polyester, polyacetal and the like, and the low-density polyethylene is particularly preferable.

Figure 4:
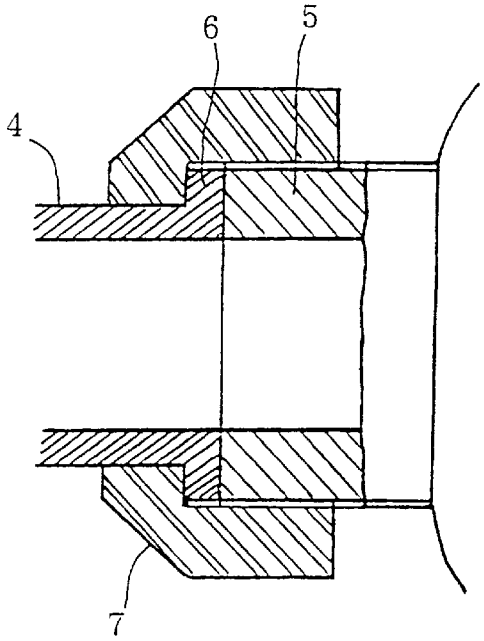
FIG. 4 is an enlarged sectional view showing a connected state of a tube's mouth and a guide pipe.

As shown in FIG. 4 in an enlarged state, the mouth part 5 of each tube 2 is connected to the guide pipe 4 with a rim 6 formed at the ends of the guide pipe 4, screwing a box-nut type cap 7, which is engaged with the rim 6, onto the mouth part 5 and tightening it to intimately contact the end face of the guide pipe 4 with the leading end face of the mouth part 5.

Now, the extrusion equipment C will be described.

In FIG. 1 and FIG. 2, reference numeral 1 denotes a base plate the bottom surface of which has a grip 8 and a lever 9 which is positioned in front of the grip 8. The lever 9 is connected with a pushing plate inclining means 10 to be described afterward. Two tubes 2 of two-part reactive curing materials are held on the base plate 1 with their respective mouths 5 directed forward.

A pushing plate 12 has its rear end engaged with the rear end of the base plate 1 by a hinge 11 so to vertically pivot on the base plate 1 and to hold bodies 13 of both tubes 2 therebetween.

Figure 3:
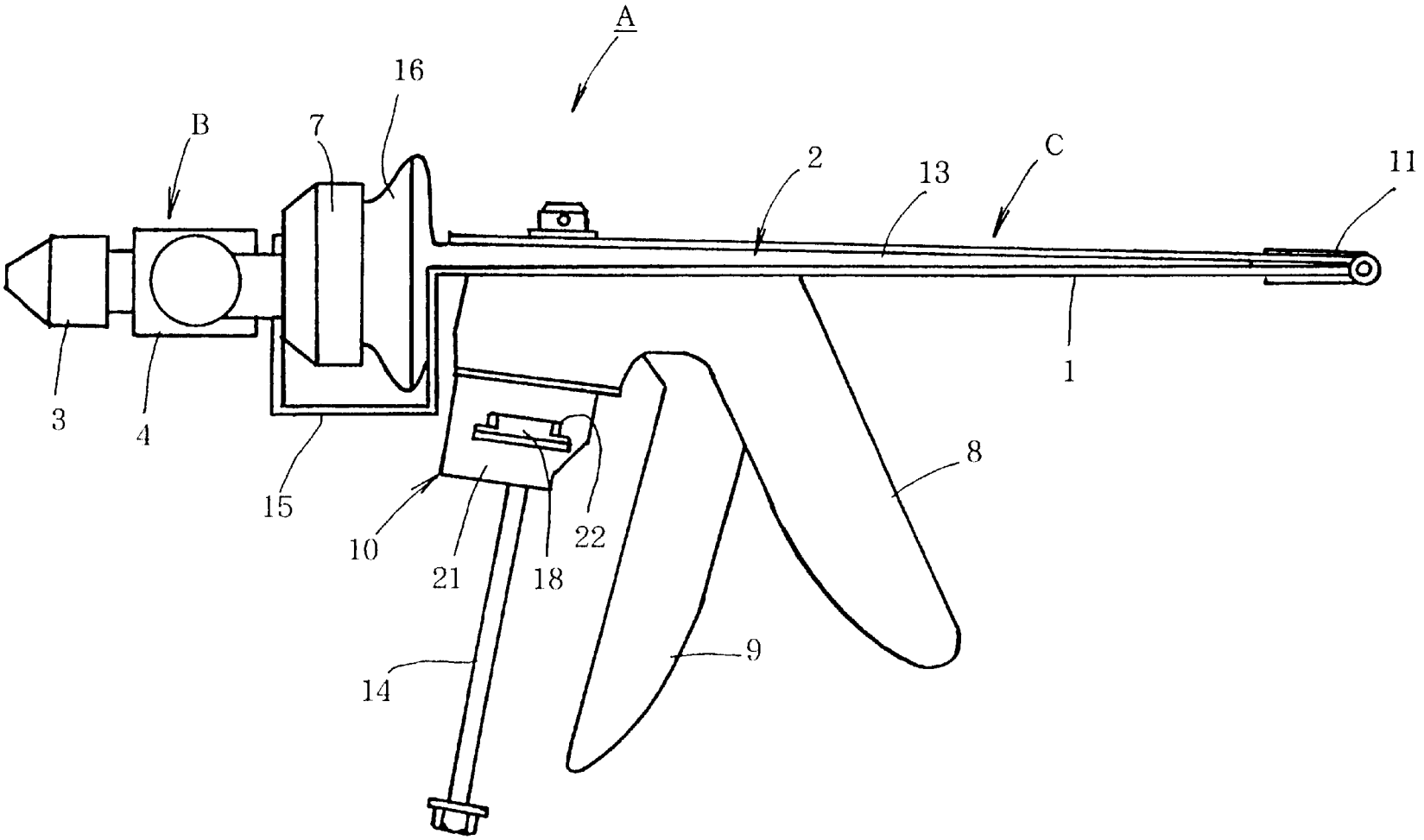
FIG. 3 is a side view showing a state that a tube body is flattened.

The pushing plate-inclining means 10 is disposed in front of the lever 9 so to be integral with the grip 8 and the lever 9. The pushing plate inclining means 10 has a slide shaft 14, the top end of which is connected with the leading end of the pushing plate 12 with play in a lengthwise direction. When the lever 9 is pulled, the pushing plate-inclining means 10 operates to lower the slide shaft 14, thereby inclining the pushing plate 12 down. Specifically, by repeating to pull and release the lever 9, the slide shaft 14 is gradually lowered stepwisely, the pushing plate 12 is accordingly inclined downward to settle in a state as shown in FIG. 3. It is seen in FIG. 3 that the front center portion of the base plate 1 is formed to have a downward hollow part 15 so to position shoulders 16 of both tubes 2 therein. Accordingly, the shoulders 16 which are generally rigid are accommodated in the hollow part 15 to facilitate uniform pushing of the bodies 13.

The pushing plate-inclining means 10 will be described in further detail with reference to FIG. 5 to FIG. 7.

The pushing plate-inclining means 10 has a push-down plate 17 and a stopper plate 18 through which the slide shaft 14, which is protruded downward through the base plate 1 (see FIG. 1 to FIG. 3), is slidably pierced.

Figure 5:
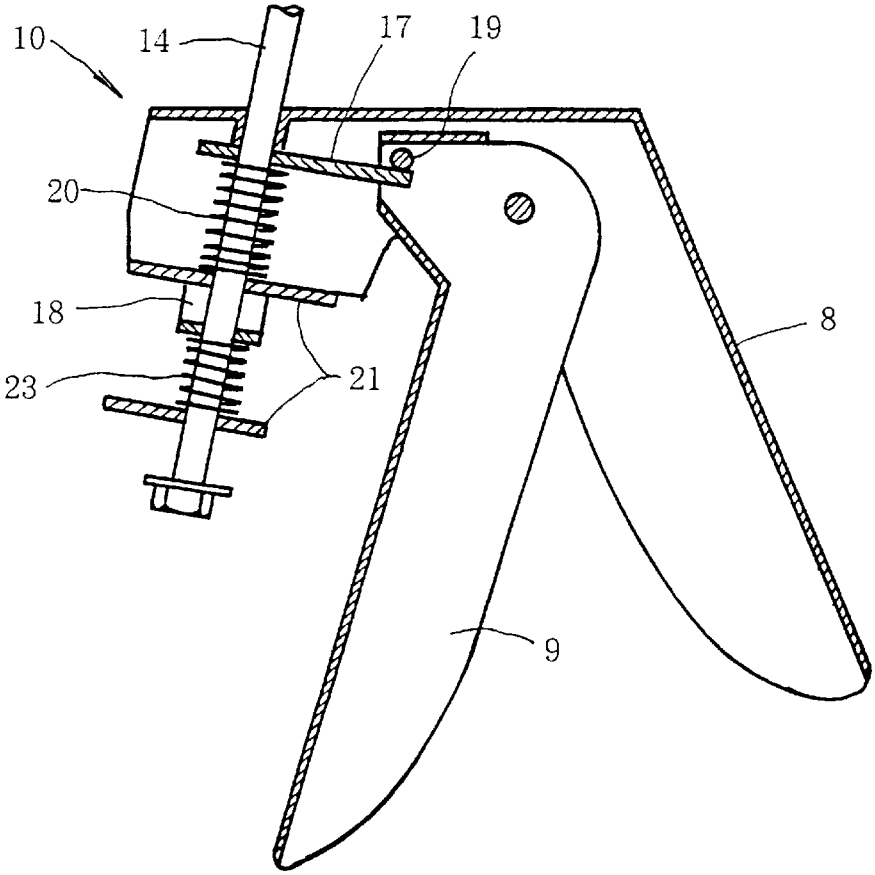
FIG. 5 is an enlarged sectional side elevation of a pushing plate-inclining means.

It is particularly apparent from FIG. 5 that the push-down plate 17 has the slide shaft 14 to penetrate its one end and a pressure pin 19 in contact with the upper face at its other end so to incline downward when the lever 9 is pulled. And, the other end of the push-down plate 17 is pushed downward when the lever 9 is pulled. The push-down plate 17 is also pushed upward by a first spring 20. The push-down plate 17 is in a position to allow the slide shaft 14 to slide by the pushing force of the first spring 20 when the lever 9 is not pulled. In other words, a hole formed on the push-down plate 17 to have the slide shaft 14 through it is in a position directed to allow the slide shaft 14 to slide in the axial direction.

Figure 6:
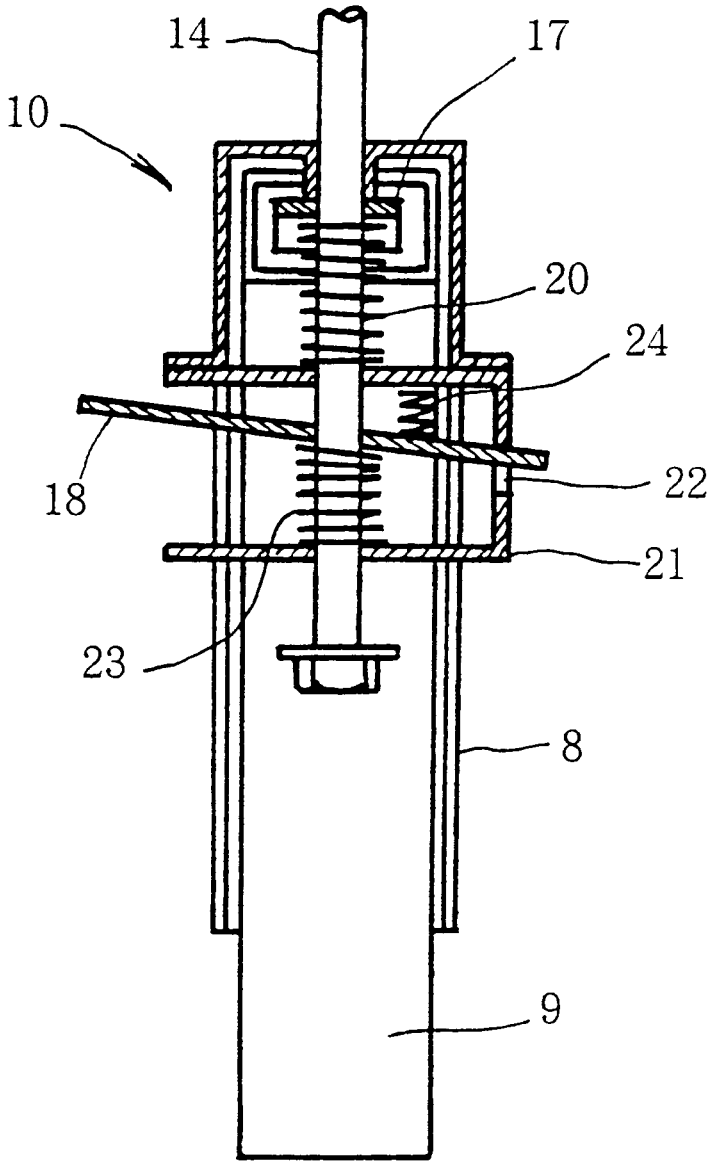
FIG. 6 is an enlarged sectional front elevation of a pushing plate-inclining means.

Meanwhile, as shown in FIG. 6 in particular, the stopper plate 18 has the slide shaft 14 penetrate its midpoint, its one end supported by a supporting hole 22 formed on a casing 21 which is integral with the grip 8 and the other end extended out of the casing 21. The stopper plate 18 is also pushed upward by a second spring 23 and inclined upward with its portion supported by the supporting hole 22 as a fulcrum. Thus, when the lever 9 is not pulled, the stopper plate 18 is engaged with the slide shaft 14 to prevent the sliding shaft 14 from sliding. Specifically, a hole formed on the stopper plate 18 to allow the slide shaft 14 penetrate it is directed to have its peripheral edge engaged with the slide shaft 14 to prevent the slide shaft 14 from sliding in the axial direction because the stopper plate 18 is inclined upward.

Figure 7:
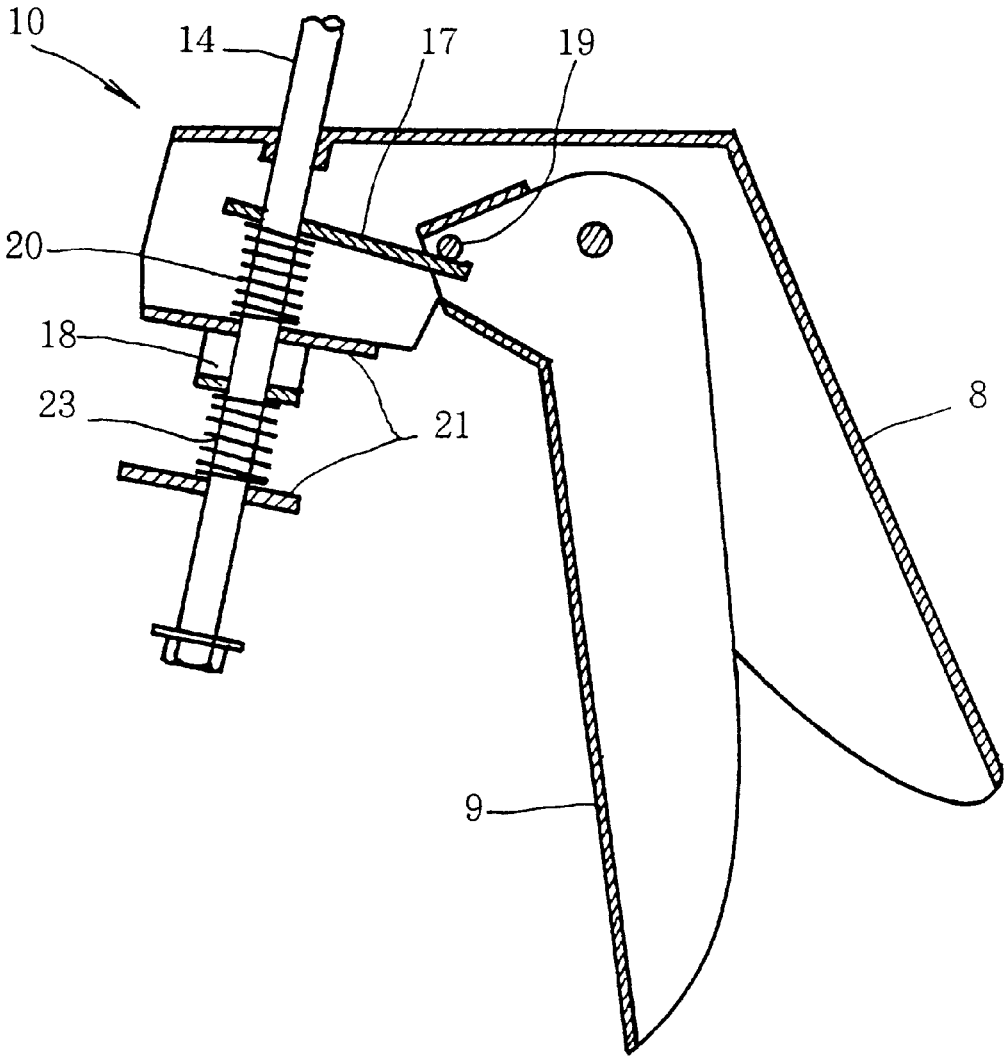
FIG. 7 is an enlarged sectional side elevation of a pushing plate-inclining means with the lever in a pulled state.

When the lever 9 is pulled from the state shown in FIG. 5 to the state shown in FIG. 7, the end of the push-down plate 17 is pushed down by the pressure pin 19. And the push-down plate 17 is slightly inclined downward with the penetrated part of the slide shaft 14 as a fulcrum. According to this little inclination downward, the push-down plate 17 falls in the similar engaged position with the stopper plate 18. Accordingly, the push-down plate 17 is further pushed down with the slide shaft 14 against the first spring 20 as the lever 9 is pulled.

When the slide shaft 14 is started to slide downward as described above, the stopper plate 18 which is in an engaged position is slightly inclined downward with the slide shaft 14 against the second spring 23 to become the same sliding position as that of the push-down plate 17 prior to pulling of the lever 9, thereby allowing the slide shaft 14 to slide downward further. Therefore, the slide shaft 14 is slid downward by an mount corresponding to the pulling level of the lever 9 to pull down the leading end of the pushing plate 12 (see FIG. 1 to FIG. 3).

When the pulling force of the lever 9 is released after pulling it for a required extent, the force for pushing down the slide shaft 14 is lost, the stopper plate 18 is pushed up by the pushing force of the second spring 23 to immediately return to the original engaged state. In this state, the force to slide the slide shaft 14 upward causes to incline the stopper plate 18 further upward with the supported part by the supporting hole 22 as a fulcrum so to reinforce the engagement of the stopper plate 18 with the slide shaft 14, and the slide shaft 14 can be prevented from being slid upward without fail. In other words, the slide shaft 14 is prevented from being returned by repulsion of the tubes 2 (see FIG. 1 to FIG. 3) which are pressed by the pushing plate 12 (see FIG. 1 to FIG. 3).

Meanwhile, since the pushing force by the pressure pin 19 is released, the push-down plate 17 is pushed up by the first spring 20 to return to the slide position and further slid to return to the original position with respect to the slide shaft 14 which is prevented from sliding upward by the stopper plate 18. At the time, the pressure pin 19 is also pushed up to return the lever 9 to the state before pulling it.

In the state that the lever 9 is not pulled, the stopper plate 18 can be put in the slide position by pushing down a portion of the stopper plate 18 extended out of the casing 21, and the front end of the pushing plate 12 (see FIG. 1 through FIG. 3) can be lifted upward by sliding the slide shaft 14 upward.

One end of the stopper plate 18 in this embodiment is supported by the supporting hole 22 formed on the casing 21 as a fulcrum for inclination in a vertical direction. This fulcrum has play vertically because the supporting hole 22 has a size with an extra room in a vertical direction. Accordingly, the fulcrum side end of the stopper plate 18, which has moved to the bottom end of the supporting hole 22 when the lever 9 is pulled, moves to the top end of the supporting hole 22 upon releasing of the pulling force of the lever 9, and the stopper plate 18 returns to the engaged state. Therefore, when the pulling force of the lever 9 is released, the pushing plate 12 (see FIG. 1 through FIG. 3) is pushed upward for the play portion by the elastic force of both tubes 2 (see FIG. 1 through FIG. 3). And, the pressures in both tubes 2 immediately after releasing the pulling force of the lever 9 can be relieved, and both materials can be prevented from flowing out of the nozzle body 3 until after releasing the pulling force of the lever 9. And, an auxiliary spring 24, which pushes down the neighborhood of the fulcrum of the stopper plate 18, moves surely the fulcrum side end of the stopper plate 18 to the bottom end of the supporting hole 22 when the lever 9 is pulled.

As described above, the fulcrum of the stopper plate 18 of this embodiment is configured by supporting the end of the stopper plate 18 in the supporting hole 22, but this support is not limited to be made by the supporting hole 22 if it becomes a fulcrum for the inclination in a vertical direction of the stopper plate 18, and it may be supported by a shaft pin (not shown). When the shaft pin is used to support, the above-described play can be provided by loosely mounting the shaft pin.

Figure 8:
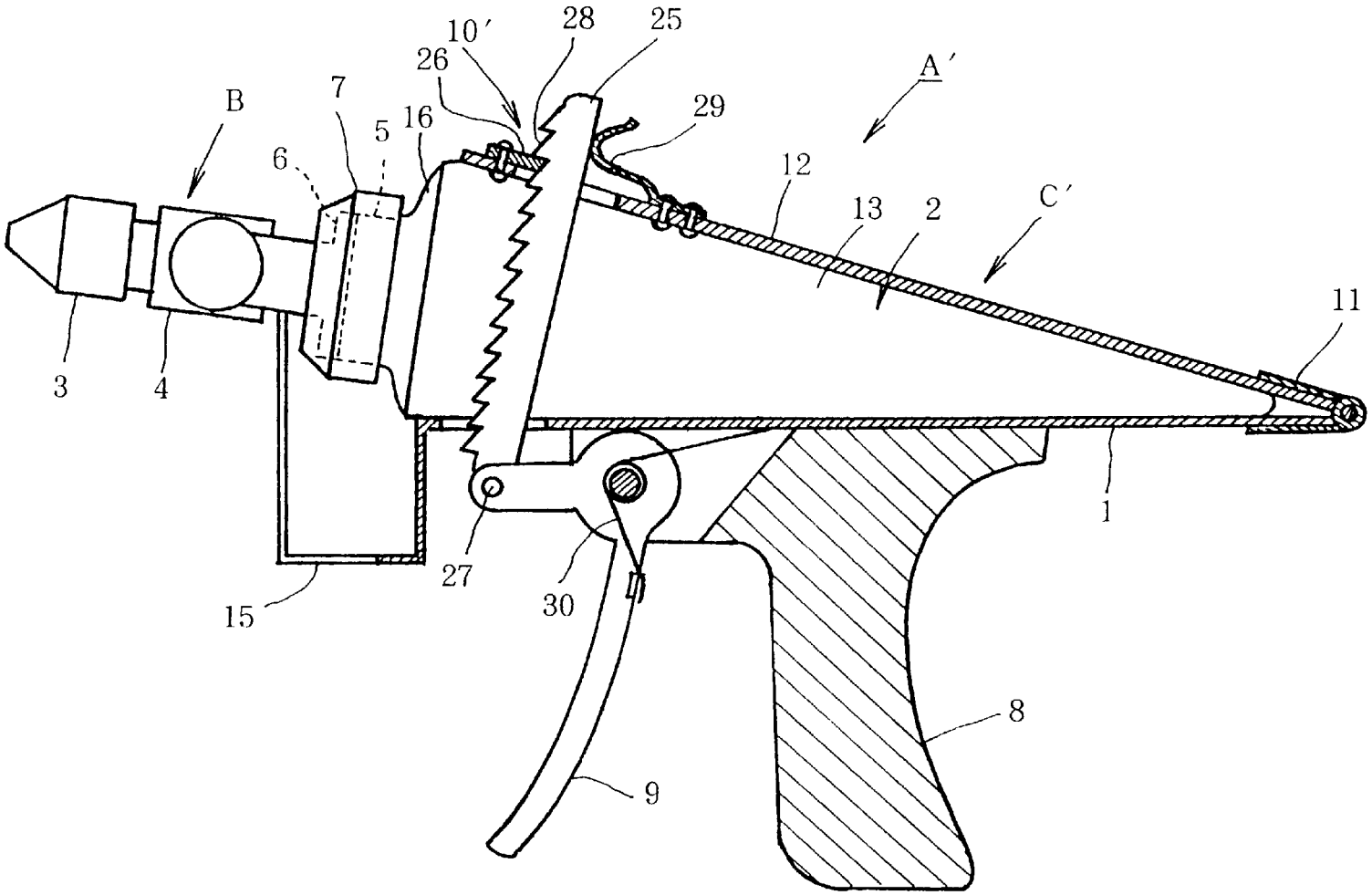
FIG. 8 is a sectional view with a partial side view of coating equipment for two-part reactive curing materials according to a second embodiment of the invention.
Figure 9:
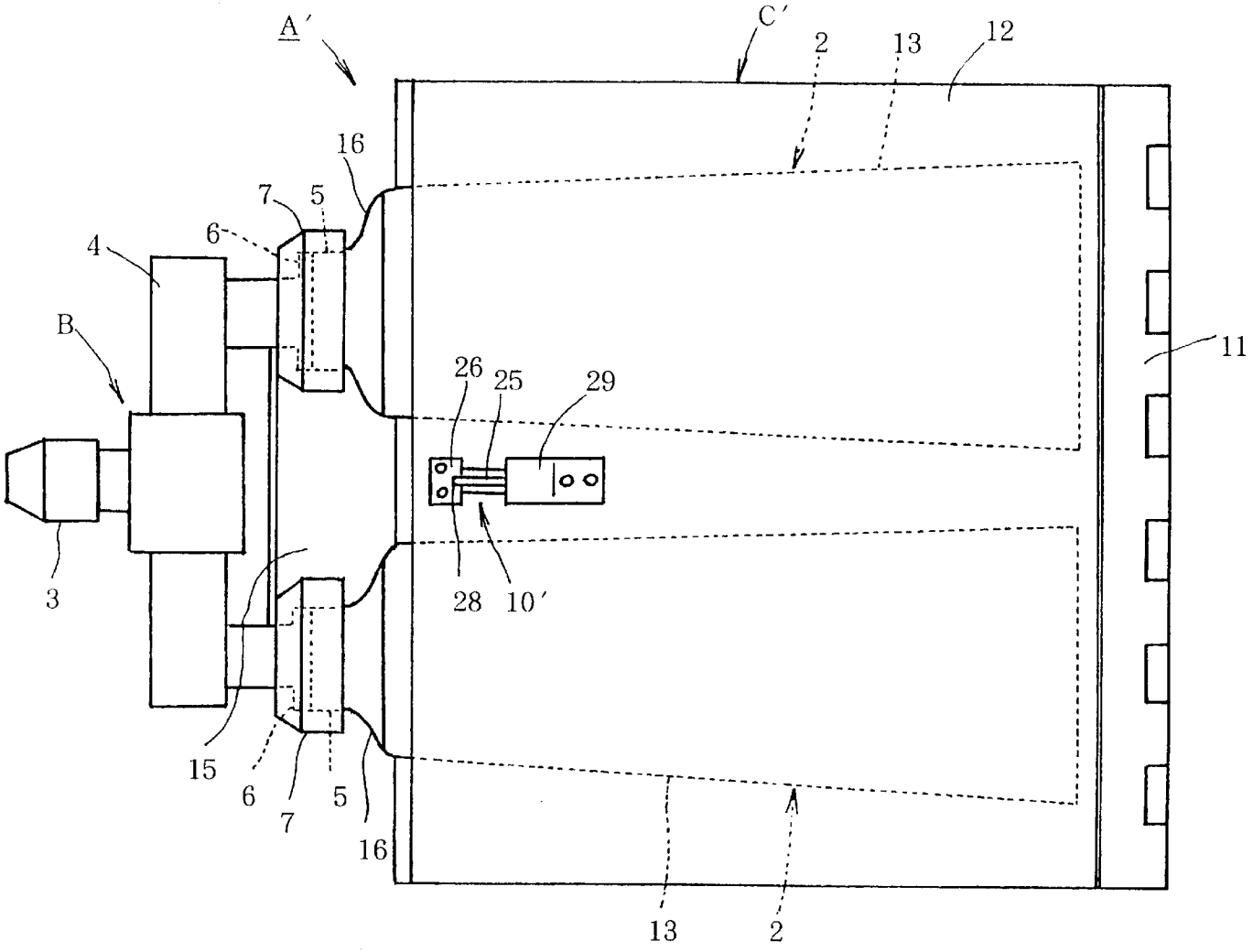
FIG. 9 is its plan view.

Now, a coating device A' according to a second embodiment of the invention will be described with reference to FIG. 8 and FIG. 9.

The coating device A' of this embodiment comprises a nozzle B similar to the one in the above-described first embodiment and an extrusion equipment C' having a pushing plate-inclining means 10' different from the above-described embodiment. The pushing plate-inclining means 10' of the second embodiment has a sliding plate 25 and a pawl 26 for transmitting the pulling force of the lever 9 to the pushing plate 12 as a force to incline the pushing plate 12 downward. It is to be understood that like reference numerals in FIG. 8 and FIG. 9 denote the like parts in FIG. 1 and FIG. 2.

The sliding plate 25 has its bottom end slidably connected to the lever 9 with a connecting pin 27 so to be slid vertically by operation of the lever 9 and pierces through the base plate 1 and the pushing plate 12 so to protrude upward out of the pushing plate 12. The sliding plate 25 has a saw-blade portion 28 which is directed forward and also downward and elastically pushed forward by a curved leaf spring 29 attached to the pushing plate 12. And, the pawl 26 fixed to the pushing plate 12 is positioned in front of the sliding plate 25, and the pawl 26 is engaged with a tooth of the saw-blade portion 28 of the sliding plate 25.

Furthermore, when the lever 9 is pulled, the sliding plate 25 is slid downward. At this time, since the tooth of the saw-blade portion 28 being pushed by the leaf spring 29 are engaged with the pawl 26, it is slid while pulling the pushing plate 12 downward to press both tubes 2 according to the pulled degree of the lever 9. On the other hand, when the pulling force of the lever 9 is released, the lever 9 is returned by a force of a lever spring 30, and the sliding plate 25 is slid upward by such return. Since the saw-blade portion 28 is directed downward, the sliding plate 25 is inclined backward against the leaf spring 29 to let the saw-blade portion 28 slip along the pawl 26, so that the sliding plate 25 is not prevented from sliding upward by the pawl 26.

When the lever 9 is pulled to squeeze both tubes 2 to some extent, the pushing plate 12 falls in a state slanted to a position (closer to the base plate 1) lower than its previous state. When the pulling force of the lever 9 is released in this state to slide the sliding plate 25 upward, the sliding plate 25 returns substantially to its previous position, so that the tooth below the tooth of the saw-blade portion 28 engaged with the pawl 26 when the lever 9 was pulled engages with the pawl 26. Therefore, by simply repeating to pull and release the lever 9, both tubes 2 are squeezed gradually to enable the simultaneous squeezing out of the two types of materials.

The two-part reactive curing materials applied to the invention include two-part caulking materials, sealing materials and paints in addition to typical two-part adhesive agents. The two-part adhesive agents include for example an acrylic adhesive agent, an unsaturated polyester-based adhesive agent, a vinyl ester-based adhesive agent, an epoxy-based adhesive agent, an urethane-based adhesive agent and other polymerization reactive curing adhesive agents. Among them, the acrylic adhesive agent is preferable because a high adhesive strength can be obtained even if two materials do not join sufficiently.

For the two-part reactive curing materials (e.g., an epoxy-based adhesive agent) requiring sufficient mixing of two materials, the nozzle body 3 having a built-in static mixer is preferably used.

Figure 10:
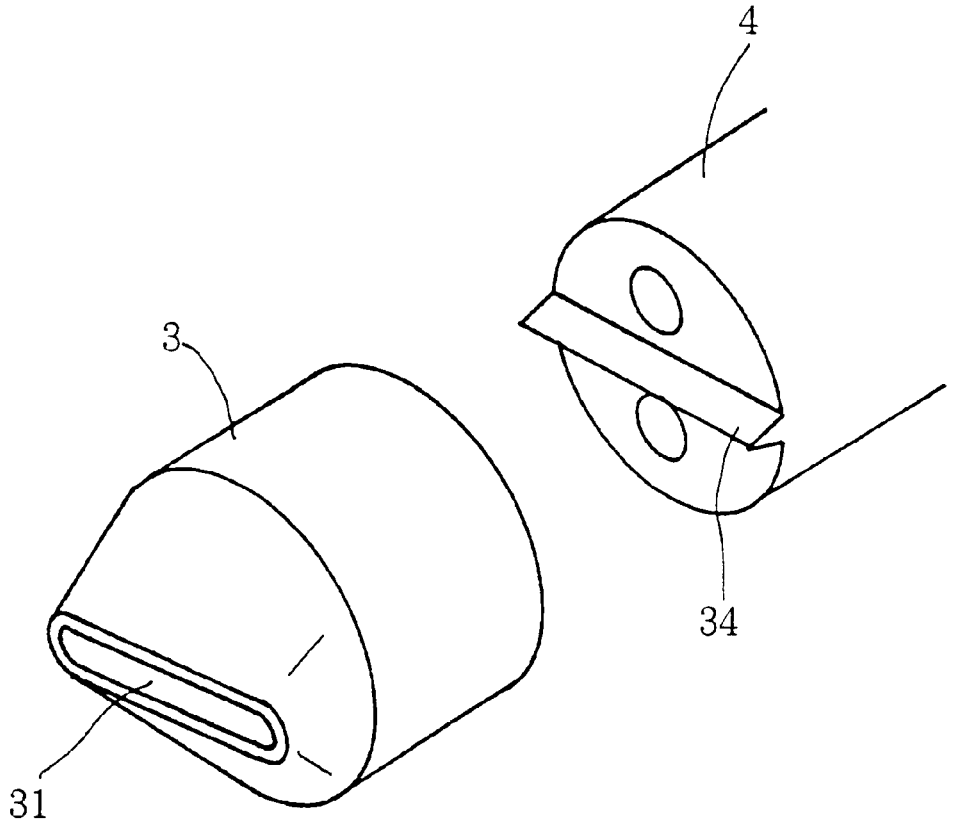
FIG. 10 is a perspective view showing one example of a preferable nozzle (neighborhood of the nozzle body)

On the other hand, the acrylic adhesive agent can provide a high adhesive strength when agents A and B squeezed out of the respective tubes 2 are contacted mutually to a certain degree. When such two-part reactive curing materials are used, the nozzle body 3 has a flat discharge port 31 as shown in FIG. 10. and extrusion of both materials (agents A and B) are preferably extruded from the guide pipe 4 to the nozzle body 3 starting from positions holding an extended region of the flat discharge port 31 therebetween so to overlay both materials in the extended region of the discharge port 31. Accordingly, both materials can be contacted mutually and discharged in a state to make curing without fail without having an expensive built-in static mixer.

The nozzle B having the above-described discharging form includes the following two types.

As shown in FIG. 11(*a*), a first type extrudes agent A 32*a* and agent B 32*b* to the nozzle body 3 from positions holding an extended region of the discharge port 31 therebetween to extrude an overlaid region of agent A 32*a* and agent B 32*b* in a state of thin laminates, so that a curing region 33 is in contact with only the periphery of the discharge port 31 of the nozzle body 3 but not in contact with the other inner periphery face of the nozzle body 3. The curing region 33 is a region where agents A 32*a* and agent B 32*b* are cured in the nozzle body 3 when they are extruded so to overlay in the nozzle body 3.

In the first type, when the nozzle body 3 is removed from the guide pipe 4 after the curing region 33 has cured owing to a long suspension or stop of work, the curing region 33 remains adhered in a plate shape to the guide pipe 4, and agent A 32*a* and agent B 32*b* remain in an uncured state within the nozzle body 3 as shown in FIG. 11(*b*). In other words, since the curing region 33 is substantially not in contact with the nozzle body 3, it is not adhered to the nozzle body 3, and the curing region 33 can be prevented from adhering to the inside of the nozzle body 3. Therefore, by peeling to remove the curing region 33 remained in the plate shape at the leading end of the guide pipe 4 and wiping off the agent A 32*a* and agent B 32*b* uncured in the nozzle body 3, the same nozzle body 3 can be used again to start operation, thus it is advantageous to repeatedly use the nozzle body 3.

A second type is of a type as shown in FIG. 12(*a*) and basically the same as the one described above, but the curing region 33 is designed to contact with not only the periphery of the discharge port 31 of the nozzle body 3 but also the forward inner periphery of the nozzle body 3.

In the second type, when the nozzle body 3 is removed from the guide pipe 4 after the curing region 33 has cured, the curing region 33 is also removed in a state adhered together with the uncured agent A 32*a* and agent B 32*b* into the nozzle body 3 as shown in FIG. 12(*b*). In other words, since the curing region 33 is also in contact with the front inner periphery face of the nozzle body 3, it is adhered to the nozzle body 3. Accordingly, dirt is hard to remain on the side of the guide pipe 4, and work can be started by mounting a new nozzle body 3. Thus, it is advantageous to make the nozzle body 3 disposable.

For the above-described first and second types, on the leading end face of the guide pipe 4 is preferably formed a protruded line 34 (preferably protruded to about 1 to 10 mm) in a direction parallel to the flat discharge port 31 to promote the overlying of both materials in the extended region of the discharge port 31 as shown in FIG. 10.

Figure 13:
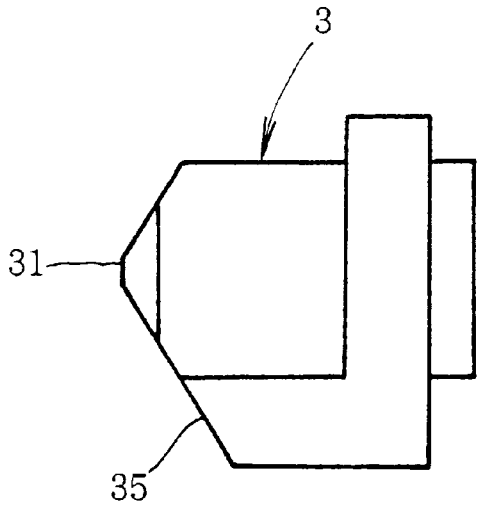
FIG. 13 is a side view showing one example of a preferable nozzle body.
Figure 14:
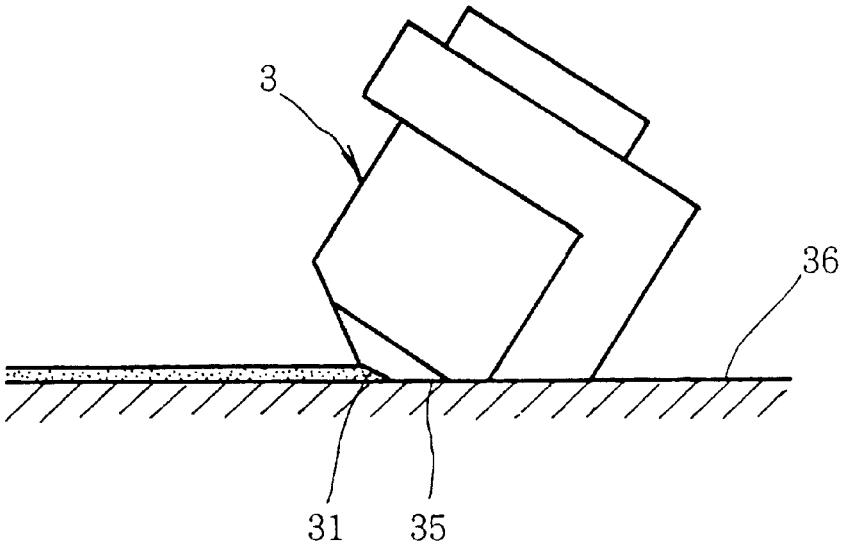
FIG. 14 is a side view showing the nozzle body of FIG. 13 being used.

FIG. 13 and FIG. 14 show another embodiment of the nozzle body 3, in which the lower side of the discharge port 31 is a slanted guide face 35 ranging from the discharge port 31. This guide face 35 is in contact with a coating face 36 to facilitate the coating of both materials on a predetermined position to a given thickness as shown in FIG. 14.

The invention, configured as described above, can discharge the two-part reactive curing materials from the nozzle B by extruding from the respective tubes 5 by holding the grip 8 and pulling the lever 9 by one hand, so that the work can be done by one hand. Besides, since the work can be made by one hand by holding the grip 8 and pulling the lever 9, the adhesive agent can be discharged with ease while moving the leading end of the nozzle B along the target position, workability is high, and the adhesive agent can be coated accurately.

What is claimed is:

1. Extrusion equipment for two-part reactive curing materials, comprising:

a base plate having a grip and a lever in front of the grip on a bottom face of the base plate, the base plate holding tubes of two-part reactive materials with their respective mouths directed forward on a top face of the base plate;

a pushing plate having a rear end pivotably fixed to a rear end of the base plate to allow a vertical inclination on the base plate and to sandwich the bodies of the tubes with the base plate; and a pushing plate-inclining means which transmits a pulling force of the lever to the pushing plate as a force to incline the pushing plate downward, wherein the pushing plate-inclining means has a sliding shaft which is pierced through the base plate to have its top end connected to the leading end of the pushing plate with play in a back-and-forth direction and a push-down plate and a stopper plate through which the sliding shaft pierces slidably below the base plate;

the push-down plate is pushed upward by a first spring into a sliding position to allow the sliding shaft to slide before the lever is pulled, inclined downward with its one end pushed down by the lever when the lever is pulled so to engage with the sliding shaft to prevent the sliding shaft from sliding and pushed downward involving the sliding shaft against the first spring, and returned to the sliding position by the pushing force of the first spring when the pulling force of the lever is released; and the stopper plate is pushed upward by a second spring to incline with its one end as a fulcrum into an engaging position so as to engage with the sliding shaft before the lever is pulled to prevent the sliding shaft from sliding, inclined downward into a sliding position to allow the sliding shaft to slide against the second spring as the sliding shaft slides downward when the lever is pulled, and returned to the engaging position by the pushing force of the second spring when the pulling force of the lever is released.

2. The extrusion equipment for two-part reactive curing materials according to claim 1, wherein the fulcrum of the stopper plate has play vertically, and an auxiliary spring is provided to push the neighborhood of the fulcrum of the stopper plate downward.

3. Extrusion equipment for two-part reactive curing materials, comprising:

a base plate having a grip and a lever in front of the grip on a bottom face of the base plate, the base plate holding tubes of two-part reactive materials with their respective mouths directed forward on a top face of the base plate;

a pushing plate having a rear end pivotably fixed to a rear end of the base plate to allow a vertical inclination on the base plate and to sandwich the bodies of the tubes with the base plate; and a pushing plate-inclining means which transmits a pulling force of the lever to the pushing plate as a force to incline the pushing plate downward, wherein the pushing plate-inclining means has a pawl mounted on the pushing plate and a sliding plate having a saw-blade portion directed downward and elastically pushed toward the pawl, the sliding plate has a bottom end pivotably fixed to the lever such that the sliding plate slides downward when the lever is pulled and the sliding plate slides upward when the lever is returned, and when the sliding plate slides downward as the lever is pulled, the saw-blade portion is engaged with the pawl to pull down the pushing plate, and when the sliding plate slides upward as the lever is returned, the saw-blade portion slides upward along the pawl.

4. The extrusion equipment for two-part reactive curing materials according to any one of claims 1 through 3, wherein a coating device for two-part reactive curing materials has a nozzle which is connected to the mouths of both tubes on the base plate for joining and discharging the materials extruded from both tubes.

5. The coating device for two-part reactive curing materials according to claim 4, wherein the nozzle portion comprises a nozzle body at its leading end and a guide pipe for guiding both materials being extruded from the mouths of both tubes to the nozzle body without joining them, and the nozzle body is removable from the guide tube.

6. The coating device for two-part reactive curing materials according to claim 5, wherein the nozzle body has a flat discharging port, and both materials are extruded from the guide pipe to the nozzle body so to be overlaid in an extended region of the flat discharge port.

* * * * *